US005390381A

United States Patent [19]

LaMantia

[11] Patent Number: 5,390,381

[45] Date of Patent: Feb. 21, 1995

[54] BEACH TOWEL/BEACH BAG COMBINATION

[76] Inventor: Mark LaMantia, 290 Broadway St., Ste. 405, Methuen, Mass. 01844

[21] Appl. No.: 222,103

[22] Filed: Apr. 4, 1994

[51] Int. Cl.[6] ..... A47G 9/02

[52] U.S. Cl. ..... 5/417; 5/485; 383/4; 190/2

[58] Field of Search ..... 383/4; 190/2; 5/413, 5/418, 419, 420, 485, 417

[56] References Cited

U.S. PATENT DOCUMENTS

| | | | |
|---|---|---|---|
| 2,315,126 | 3/1943 | Michalke | 5/417 |
| 2,344,010 | 3/1944 | Walsh | 5/417 X |
| 3,477,552 | 11/1969 | Goldman | 190/2 |
| 4,197,891 | 4/1980 | Lomollo | 383/4 |
| 4,375,111 | 3/1993 | Hall | 190/2 X |
| 4,468,810 | 8/1984 | Longo | 5/417 X |
| 5,048,975 | 9/1991 | Holbrook | 190/2 X |
| 5,103,515 | 4/1992 | Bird | 5/417 X |

*Primary Examiner*—Michael F. Trettel
*Attorney, Agent, or Firm*—Wolf, Greenfield & Sacks

[57] ABSTRACT

A beach towel/beach bag combination is made of a rectangular sheet of toweling that is folded transversely into three panels which overlie one another. The three panels are folded together along a longitudinal center line of the toweling and a zipper is provided along a portion of the edge of the toweling so as to retain the toweling in the beach bag configuration. A handle is also secured to the toweling so as to facilitate carrying of the beach bag particularly when it is full. The handle may be made of webbing and form an extension of a reinforcing strip that extends from the top to the bottom of the bag. When the bag is unzipped, the towel may be spread flat to serve as a beach towel.

6 Claims, 2 Drawing Sheets

BEACH TOWEL/BEACH BAG COMBINATION

SUMMARY OF THE INVENTION

This invention relates to beach accessories and more particularly comprises a combination beach towel and beach bag.

It is customary for those going to the beach or pool to carry a variety of articles such as towels, food and drink, refreshments, toys and a change of clothing, and frequently a beach bag is used to carry most or all such articles. Of the several articles taken to the beach or pool, the beach towel is most often the biggest single article, and not infrequently it is too big to fit in the beach bag. In such cases, the towel is carried as a separate item, which is inconvenient and sometimes difficult.

The primary object of the present invention is to provide a beach accessory which can serve both as a beach towel and a beach bag to thereby reduce the number of separate articles taken o the beach and provide a convenient means of carrying all of the articles in a single package.

Another object of the present invention is to provide a beach bag/beach towel combination that may be converted from one use to the other very quickly and conveniently.

To accomplish these and other objects, the beach bag/beach towel combination of the present invention is made from a rectangular sheet of toweling. The toweling is of a size and weight which allows it to be folded transversely in thirds into three panels which overlie one another. The three panels thereafter are folded along the longitudinal center center line of the toweling, and a zipper secured to opposite side edges and one end edge of the toweling enables the three panels so folded to be secured together to form a bag. The bag is strengthened by a strip of webbing that is sewn along the longitudinal center line of the toweling on one panel thereof, and the webbing extends from the end edge and beyond the opposite end of the panel to form a handle. One end of the handle is secured to the toweling at a point transversely aligned with the point where the other end of the handle is connected to the toweling.

These and other objects and features of the present invention will be better understood and appreciated from the following detailed description of one embodiment thereof, selected for purposes of illustration and shown in the accompanying drawings.

BRIEF FIGURE DESCRIPTION

DETAILED DESCRIPTION

Figure 1:
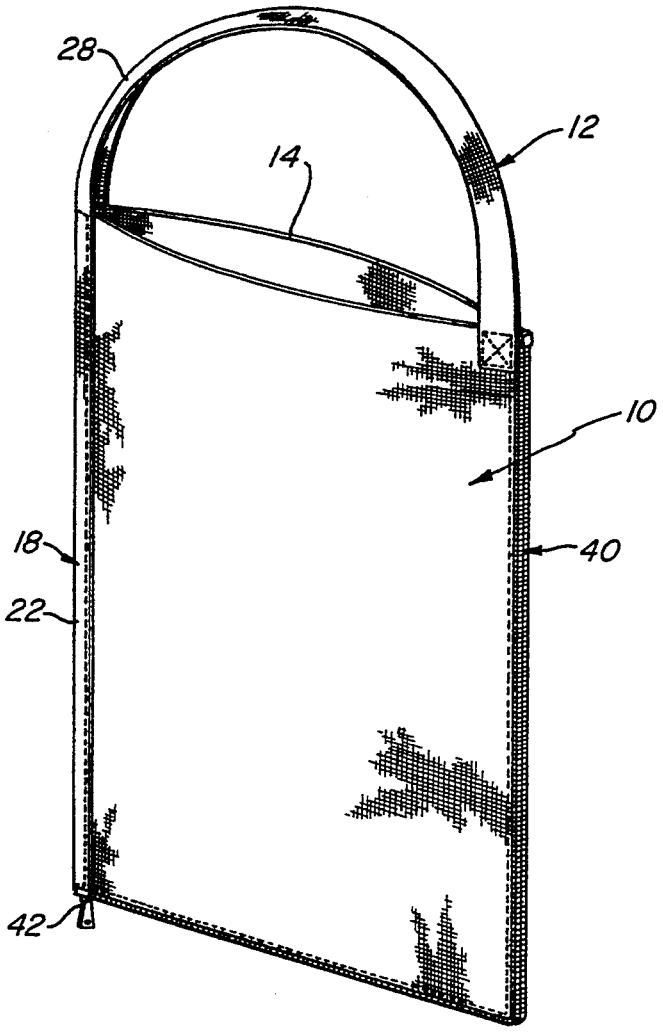
FIG. 1 is a perspective view of the beach towel/-beach bag combination of the present invention assembled in the beach bag configuration.
Figure 2:
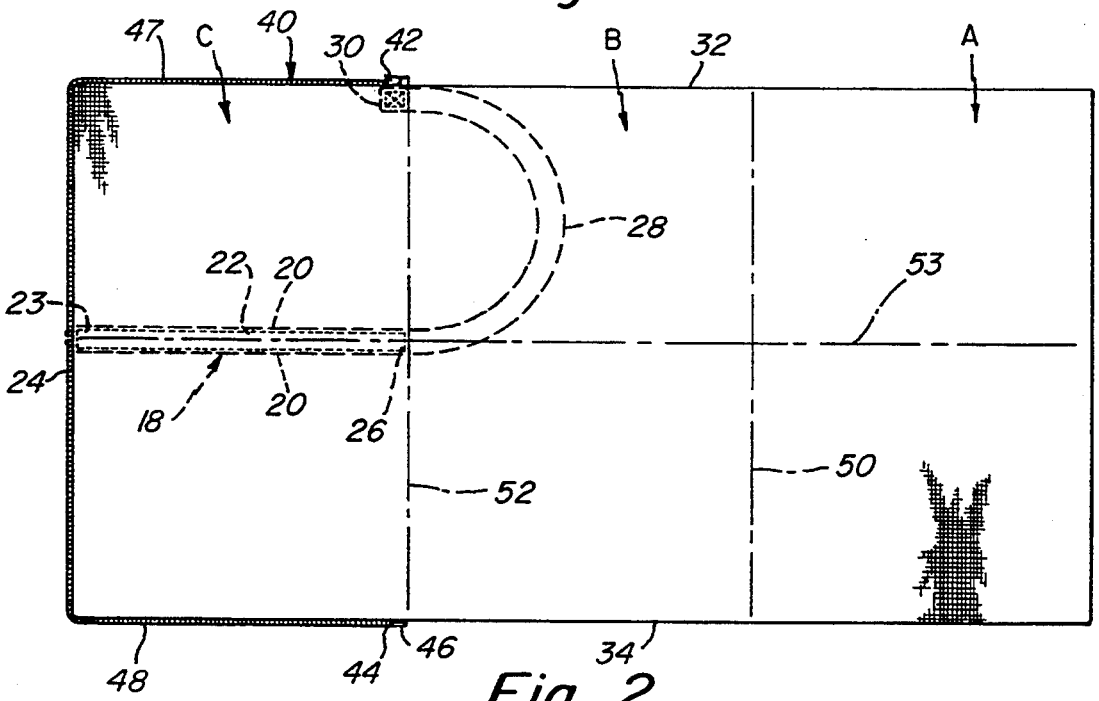
FIG. 2 is a plan view of the present invention in the open or beach towel configuration.

In FIGS. 1 and 2, the present invention is shown in the beach bag and beach towel configurations, respectively. In the beach bag configuration of FIG. 1, the assembly includes a bag body 10 with a handle 12, open at the top 14 and held together by a zipper 16 which extends along one side thereof and along the bottom. The towel from which the beach bag is made may be of any size, but preferably is approximately 30×60 inches and made of terrycloth toweling of conventional manufacture. The toweling may carry a decorative pattern of any variety on one or both sides. When he toweling of the dimensions recited is folded into the bag configuration of FIG. 1, the bag circumference and height are 30 inches and 20 inches, respectively.

On one side of the towel as shown particularly in FIG. 2, a strip of webbing 18 which may be made of cotton or some similar, washable material having appreciable strength, is sewn along its edges 20 into a J-shaped configuration. The stem 22 of the J-shaped webbing 18 extends longitudinally along the central line of the toweling approximately ⅓ of the towel length or about 20 inches in the example described. One end 23 of the webbing 18 is disposed adjacent the edge 24 of the toweling, and the opposite end 26 of the stem of the webbing is located approximately ⅓ of the longitudinal length of the towel away from the edge 24. The curved portion 28 of the J-shaped webbing is approximately 26 inches long an is sewn to the toweling only at the end 30 adjacent the towel edge 32. Thus, the body of the curved portion of the webbing 28 is free of The toweling except at its ends and therefore may function as a handle as shown in FIG. 1. If but one side of the toweling is patterned, preferably the webbing is attached to that face so that the webbing is exposed particularly at the handle 12 when the toweling is folded to the bag configuration.

A zipper 40 is shown in FIG. 1 to extend along the left third of the top and bottom longitudinal edges 32 and 34 and across the end edge 24. When the toweling is in the beach towel configuration, the zipper, just as the strap 18, performs no function. Both are provided for use when the towel is in the beach bag configuration of FIG. 1. The zipper slide is suggested at 42, and the opposite end 44 of the zipper 40 is provided with an insert 46 which is engaged in the slide 42 in the conventional manner when the bag is assembled by closing the zipper as described below. The zipper 40 has two parts, 47 and 48. Any type of zipper may be used, that is, metal, plastic or fabric strips, although it is preferred that the zipper be made of a nonoxidizing material to avoid discoloration of the toweling and assure smooth operation.

Figure 3:
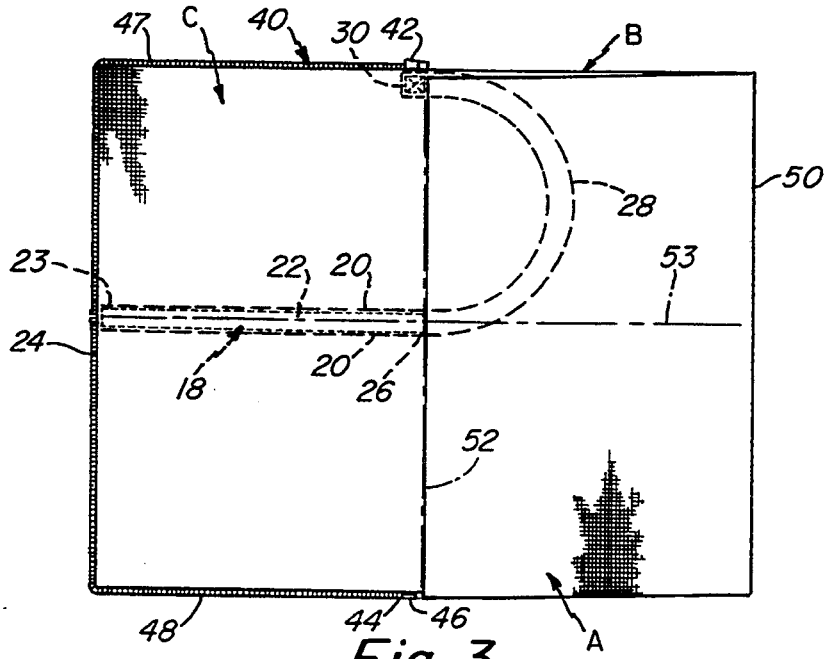
FIGS. 3–5 illustrate the various steps of folding the beach towel and closing its zipper to assemble the towel into the beach bag configuration of FIG. 1.
Figure 4:
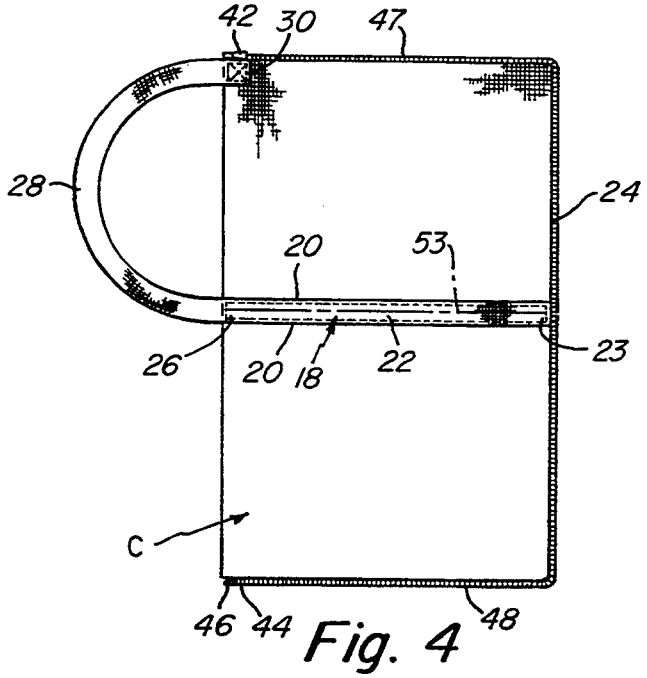
Figure 5:
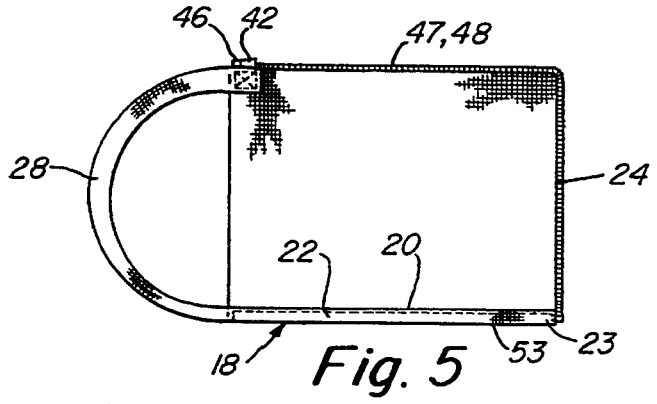

The toweling is assembled into the bag configuration in the following manner. The towel is spread flat to the configuration of FIG. 2 and the J-shaped strap 18 is disposed on the underside of the toweling. As a first step, the right third A of the spread toweling is folded over the center third B along the imaginary fold line 50 as shown in FIG. 3. Next, the left third C is folded over the center third B of the towel along the imaginary fold line 52 so as to overlie the panels A and B as shown n FIG. 4. Finally, the toweling folded in thirds is again folded in half along fold line 53 as shown in FIG. 5 which is coincident with the longitudinal centr line of the toweling. With the towel folded in the manner described, the part 47 of the zipper overlies and is immediately adjacent and contiguous with the other part 48. In that position, the insert 46 can be slipped into the slide 42 of the zipper on the opposite side, and the zipper can be closed. Assembled in that fashion, the handle portion 28 of the webbing 18 may extend freely out he top of the bag so as to provide a convenient carrying handle 12 or shoulder strap for it.

The advantages of the beach towel/beach bag combination are many. The device provides the user with a beach bag to carry the many things that are normally taken to the beach or pool such as children's toys, food, beverages, and change of clothing, etc., and the user is relieve of the chore of carrying a separate towel which is inconvenient to carry along with the many other things normally taken to the beach. Once at the beach or pool, the bag may be unpacked and then unzipped and spread on the sand or deck to perform all of the normal functions of a beach towel, including serving as a surface to lie on and as a towel to dry one's self. When leaving the beach, the towel may again be assembled into the bag configuration and the many items carried to the beach may be again stored in the bag. The beach bag function is in no way impaired by the toweling being wet.

Having described this invention in detail, those skilled in the are will appreciate that numerous modifications may be made of this invention without departing from its spirit. For example the towel may be of an convenient size and obviously is not limited to the specific dimensions provided by way of example in he foregoing description. The webbing 28 may function not only as a carrying handle but as a shoulder strap as well, and the length of the strap may be made adjustable. Because of the many modifications that may be made of this invention, it is not intended that the breadth of the invention be limited to the specific embodiment illustrated and described. Rather, its scope is to be determined by the appended claims and their equivalents.

What is claimed is:

1. A beach towel/beach bag combination comprising a rectangular sheet of toweling approximately twice as long as it is wide and having longitudinal side edges and end edges, a strap having a first portion stitched to the toweling along the longitudinal center line of the toweling and extending from one end edge approximately one third the length of the toweling and having a second portion forming a continuation of the first portion and free of a connection to the toweling except at the end remote from the first portion which is stitched to the toweling at one longitudinal edge approximately the same distance from the said one end edge of the toweling as the other end of the second portion, and a zipper stitched to the toweling across the said one end edge and along approximately one third of the longitudinal edges of the toweling whereby the toweling sheet can be folded transversed in third and thereafter longitudinally in half so the zipper ends may be joined and with the zipper fastened together so that the second position forms a handle loop at the end of the folded toweling remote from the said one end.

2. A beach towel/beach bag combination comprising:

a rectangular sheet of toweling capable of being folded transversely into three overlapping panels joined by two folds, said toweling having end and side edges, a pair of zipper halves stitched to the opposite side edges of he toweling and each half extending from the ends of one of the folds to the nearer end edge and along that end edge to he approximate center of the end edge thereof, and a handle strap stitched at each end to the toweling at the said end of the folds, one end at the approximate center of the fold and the other end at one side edge thereof whereby the twice transversely folded sheet may be folded in half on a third fold perpendicular to the other fold and the zipper may thereafter be closed to form a beach bag with a handle.

3. A beach towel/beach bag combination as defined in claim 2 wherein a webbing is attached to one of the panels along the longitudinal center line of the toweling.

4. A beach towel/beach bag combination as defined in claim 3 wherein the webbing and handle are connected together.

5. A beach towel/beach bag combination as defined in claim 4 wherein the handle and webbing are a continuous strip and are stitched to the toweling.

6. A beach towel/beach bag combination as defined in claim 2 wherein the towel has a pattern on one side thereof, and the handle is stitched to that side of the toweling.

* * * * *